United States Patent [19]

Billottet et al.

[11] 4,353,284

[45] Oct. 12, 1982

[54] CARRIED WEAPON SYSTEM WITH A HIGH ORIENTATION MOBILITY

[75] Inventors: Henri Billottet; Henri Augy; André Quoy, all of Paris, France

[73] Assignee: Thomson-CSF, Paris, France

[21] Appl. No.: 146,332

[22] Filed: May 2, 1980

[30] Foreign Application Priority Data

May 8, 1979 [FR] France ..... 79 11628

[51] Int. Cl.[3] ..... F41F 23/10

[52] U.S. Cl. ..... 89/40 B; 89/1.815; 89/41 AA; 180/236

[58] Field of Search ..... 89/1.8, 1.815, 36 H, 89/40 B; 180/236

[56] References Cited

U.S. PATENT DOCUMENTS

| | | | |
|---|---|---|---|
| 2,933,981 | 4/1960 | Anderson et al. | 89/36 H |
| 2,966,828 | 1/1961 | Berge | 89/40 B |
| 3,395,672 | 8/1968 | Ruf | 89/36 H |
| 3,666,034 | 5/1972 | Stuller et al. | 180/236 |
| 3,946,640 | 3/1976 | Baumann | 89/1.815 |

FOREIGN PATENT DOCUMENTS

| | | | |
|---|---|---|---|
| 871358 | 6/1961 | United Kingdom | 180/236 |

*Primary Examiner*—Stephen C. Bentley
*Attorney, Agent, or Firm*—Karl F. Ross

[57] ABSTRACT

Carried weapon system with a high orientation mobility in elevation and bearing.

The elevation mobility is ensured by eliminating the turret and the provision of a shaft in the vehicle superstructure in accordance with its longitudinal axis and the fixing of the weapon to its cradle in said shaft which is open towards the top and front and beneath the weapon towards the bottom. The mobility in bearing is ensured by the self-rotation of the vehicle which displaces the weapon.

Such movable turretless weapon system is able to fire at land, maritime and air targets.

6 Claims, 9 Drawing Figures

CARRIED WEAPON SYSTEM WITH A HIGH ORIENTATION MOBILITY

FIELD OF THE INVENTION

The present invention relates to a carried weapon system with a high orientation mobility. More specifically the invention deals with weapons in the form of one or more tubes for the launching of artillery shells, rockets, missiles, etc. These tubes must be oriented in elevation and bearing, generally from a self-propelled platform, permitting rapid movement between different firing points, no matter what the nature of the land on which the platform has to move. It must also be possible to aim the weapons in the direction of a moving or fixed land-bound or air-borne target at any altitude.

BACKGROUND OF THE INVENTION

According to the prior art, a weapon platform can be a vehicle on wheels or tracks on which is mounted a turret protecting the weapon and which is movable to traverse the weapon and carries an elevation axis. Thus, the orientation of the weapon in bearing and elevation is linked with the turret. However, this has serious disadvantages when it is desirable for the weapon to have a large elevation range of approximately −15° to 85° for a bearing range of 360°. Under these conditions, it is necessary to have a very high turret for the weapon to be free at the rear of the superstructure of the carrying vehicle.

It is then possible to envisage a turretless carrying vehicle, whose external appearance has been modified in order to provide the gun crew with the protection provided by the turret. However, this has the serious disadvantage that the bearing mobility of the weapon is limited to that of the vehicle.

It is obvious that the known tracked and wheeled vehicles cannot operate like a turret even if they can pivot with a relatively small turning radius, as is the case more particularly with tracked vehicles. Thus, they are unable to bring about the bearing positioning of a weapon with the minimum required accuracy, particularly when it is necessary to fire at rapidly moving targets.

OBJECT OF THE INVENTION

The object of the invention is to provide a vehicle-borne weapon system having a very considerable orientation mobility, but in which the weapon is not housed in a moving turret.

SUMMARY OF THE INVENTION

According to the invention, the weapon in the form of a single or multiple tube launcher for artillery shells, rockets, missiles, etc. is positioned in a vehicle, whose driving and guide wheels are such that they can be placed in a position ensuring the self-rotation of the vehicle about a point located on its longitudinal axis, the self-rotation bringing about the azimuthal displacement of the weapon linked therewith.

According to the invention, the self-rotatable vehicle facilitates the operation of the weapon, no matter what the conditions of use. It is provided with any appropriate means for aiding and facilitating the use of the weapon in order to constitute an autonomous weapon system.

BRIEF DESCRIPTION OF THE DRAWING

The invention is described in greater detail hereinafter relative to non-limiting embodiments thereof shown in the attached drawing, in which.

SPECIFIC DESCRIPTION

In the introduction to the specification, particular stress was placed on one of the basic characteristics of the present weapon system, namely its very considerable mobility. This mobility applies both to the carrying vehicle and to the carried weapon, the great mobility of the former leading to the great mobility of the latter. This feature eliminates from the outset the necessity of placing the weapon under a turret which, through being movable in bearing, drives it independently of the vehicle.

Figure 1:
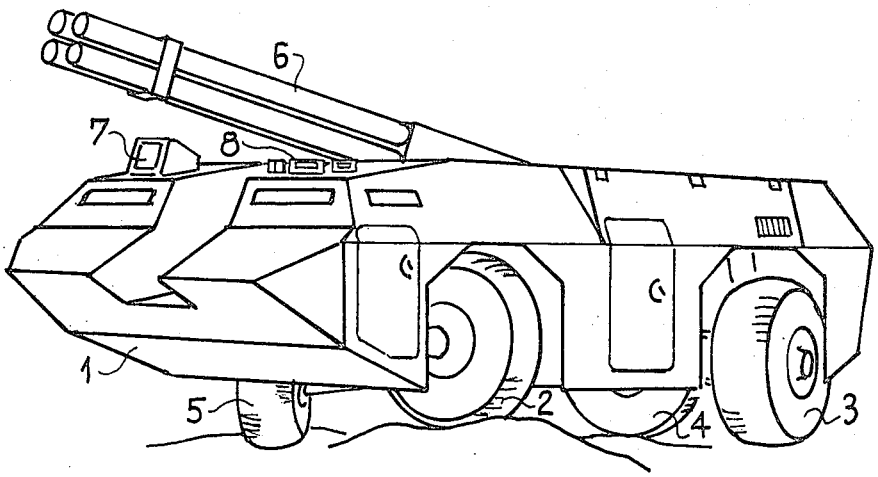
FIG. 1 is a perspective view taken at ground level of the weapon system according to the invention.

FIG. 1 is a general view of the weapon system according to the invention. The carrying vehicle 1 is of the armored type having wheels which are both guide and driving wheels. In this embodiment, it has four wheels, but this number can be six, eight or even more. These wheels are designated at 2, 3, 4 and 5. This vehicle serves as a support for a weapon 6, in this case a gun with four tubes or barrels, although this is not limitative. This gun is fixed to the vehicle by means for example of a cradle (not shown in the drawing) which is movable in elevation about pivot pins whose axis forms the elevation axis of the weapon and the longitudinal axis of the vehicle. Thus, this weapon is in itself not movable in bearing. However, as is shown by FIG. 1, wheels 2, 3, 4 and 5 can assume positions which appear to be somewhat peculiar. Thus, and this is a characteristic of the carrying vehicle, the wheels which have both a driving and a guidance function can assume a position whereby they are made tangential to one or more concentric circles, whose center is positioned on the longitudinal axis of the vehicle and permit the latter to autorotate about said point. This leads to the self-rotation of the weapon fixed to the vehicle and this movement is equivalent to the movement in bearing.

In forming a weapon system, the vehicle 1 and the weapon 6 have other means such as a sighting system 7 with a firing computer and an objective designation device, episcopic sight and/or target designation radar 9.

Figure 2:
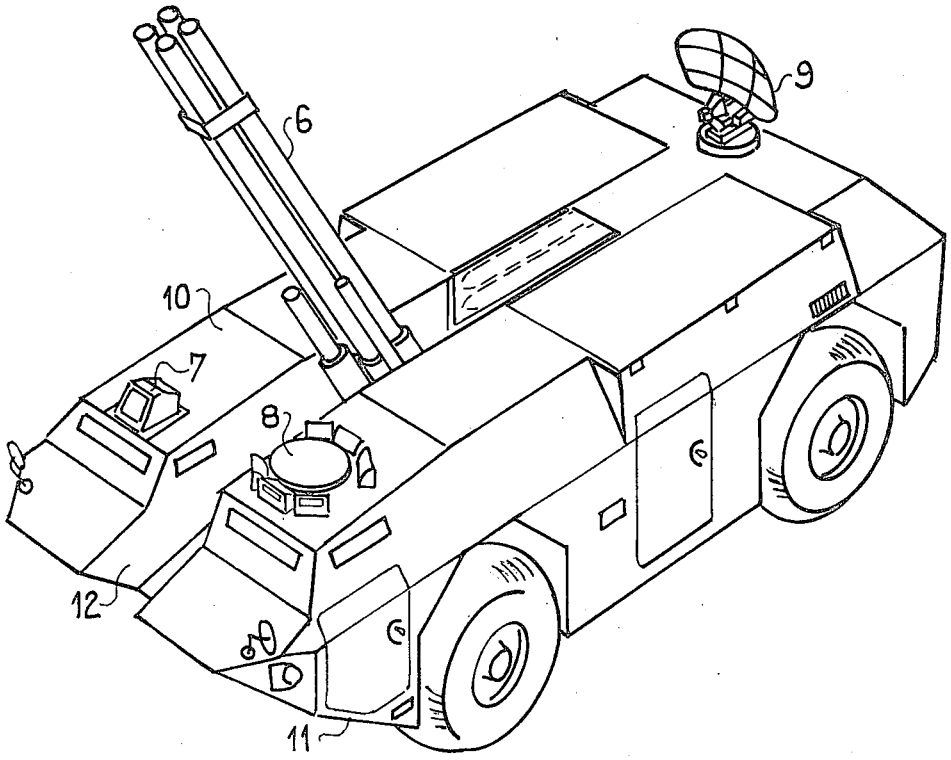
FIG. 2 is a perspective view taken from above of the weapon system.

FIG. 2 shows another overall view of the weapon system showing more clearly the position of the weapon in the vehicle and where it is also possible to see the target designation or monitoring sensor 9 mounted on the vehicle. It should be noted that the position of the weapon permits a high elevation firing. The superstructure 10 of the vehicle which is fixed to the perimeter of chassis 11 and in the vehicle axis has a channel 12 which is open towards the top and front and below the weapon towards the ground. This arrangement provides an excellent elevation range and as the shaft is open towards the ground firing residues can easily be ejected through the bottom of the vehicle.

Figure 3:
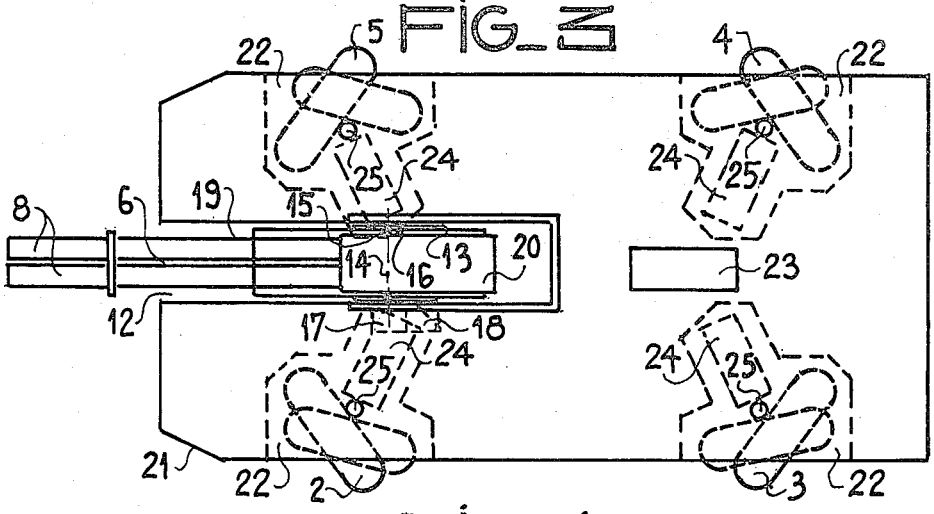
FIG. 3 is a plan view of the carrying vehicle with its weapon.

FIG. 3 is a plan view of the vehicle making it possible to complete the description of the weapon system constituted by the vehicle according to the invention. The weapon rests on cradle 13, which is movable in elevation about an axis 14 passing through the pivot pins 15. Cradle 13 carries a toothed segment 15 driven by the output pinion of the elevation reduction gear 17 in superstructure 10 and the elevation reduction gear box carries the elevation remote control electric motor of weapon 18. The moving cradle 13 also carries all the slides 19 permitting recoil and supporting the fixing of the weapon, the recoil absorbers and the springs which return the weapon to the forward firing position.

The actual weapon is connected to the slides by its support. The weapon can have one or more tubes, but in all cases it has a closed breech 20 the recoil force of about 5 metric tons or higher being taken up by the pivot pins.

The carrying vehicle is designed so as to carry the weapon and provided with the possibilities described hereinbefore. The vehicle has also all the members necessary for its propulsion, the servicing of the weapon and the servicing of the weapon system. In particular, the vehicle is designed so that the wheels serve both to move the vehicle and to autorotate the same, permitting the directional aiming of the weapon.

The carrying vehicle 1 essentially comprises a chassis 21 carrying all the other necessary elements, some of which have already been referred to. The chassis is constituted by a rigid frame 21 which carries at four corners of a rectangle fastenings 22 for the suspension, at the rear the fixing by means of silent blocks, the combustion motor 23 and its electric generating set for propulsion and automatic guidance systems, as well as the hydraulic generator for the suspension.

The chassis carries the four electric motor power plants comprising the four hydraulic system suspensions for the present four wheeled vehicle, the four wheel electric motors 24, each being connected to the corresponding wheel by a homokinetic joint permitting a deflection of the wheel by $\pm 30°$ relative to the motor, the four wheels with their brake and their tacheometric generator 25.

The chassis also carries the two steering boxes, one at the front and one at the rear, each box being duplicated to permit the independent control of each wheel for self-rotation.

The chassis also carries the aforementioned superstructure which protects the equipment and gun crew. The superstructure is fixed to the entire chassis perimeter and provides a better overall rigidity. Within the assembly, there are interconnections with the coupling box of the motors and the guidance system box, as well as the vehicle computer. Externally, it carries all the members listed with reference to FIGS. 1 and 2.

Figure 4:
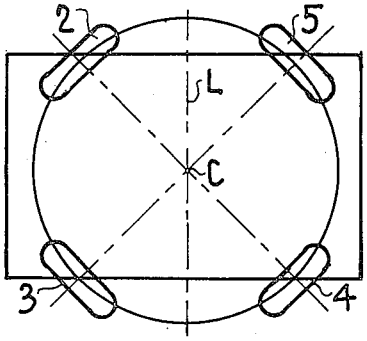
FIG. 4 is a diagrammatic view of the vehicle wheels in the vehicle-rotating position.

FIG. 4 shows how the wheels of the vehicle carrying the weapon must be oriented in order to permit self-rotation thereof. Wheels 2, 3, 4 and 5 must be tangential to a circle, whose center C is positioned on the longitudinal axis L of vehicle V.

Figure 5:
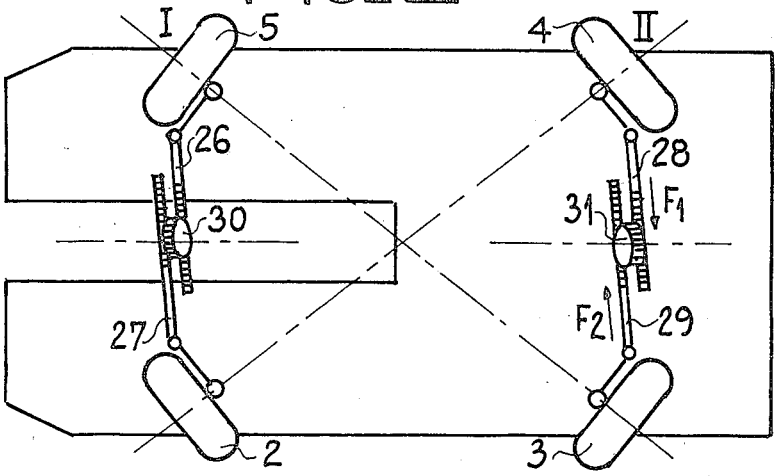
FIG. 5 is a diagrammatic bottom view of the vehicle wheel control system.

FIG. 5 shows how the vehicle wheels are controlled for self-rotation of the vehicle. The steering rods 26, 27, 28 and 29 for a four-wheeled vehicle are controlled independently from steering boxes 30 and 31, so that they move in opposite directions to one another. If, for example, rods 26 and 28 belonging respectively to gears 1 and 2 move in the direction of arrow F1, rods 27 and 29 move in the opposite direction indicated by arrow F2.

All the arrangements described hereinbefore give the weapon-carrying vehicle a certain number of advantages permitting its use as a weapon system against air and land targets, during movement or self-rotation on random ground surfaces.

The hydraulic suspension used prevents any interference to the equipment used on the vehicle and which are necessary for the detection of targets, their tracking and for firing purposes. The interference can be constituted by vibrations caused by the running of the vehicle or by a mechanical gear box. As the latter is not encountered on the present vehicle, the generating set is flexibly secured, so that there is no vibration of the vehicle chassis. Moreover, the hydraulic suspension enables the vehicle to maintain a stable attitude both when travelling and on stopping when the vehicle autorotates on a non-planar surface.

Under these conditions and in accordance with the invention, the determination of the bearing of the weapon when starting to fire at a target or during the tracking thereof is effected by the self-rotation of the carrying vehicle and the control of the servomechanisms of the vehicle wheels from data supply, for example, by the sight glass 7 and converted by the computer installed on vehicle 6.

Figure 6:
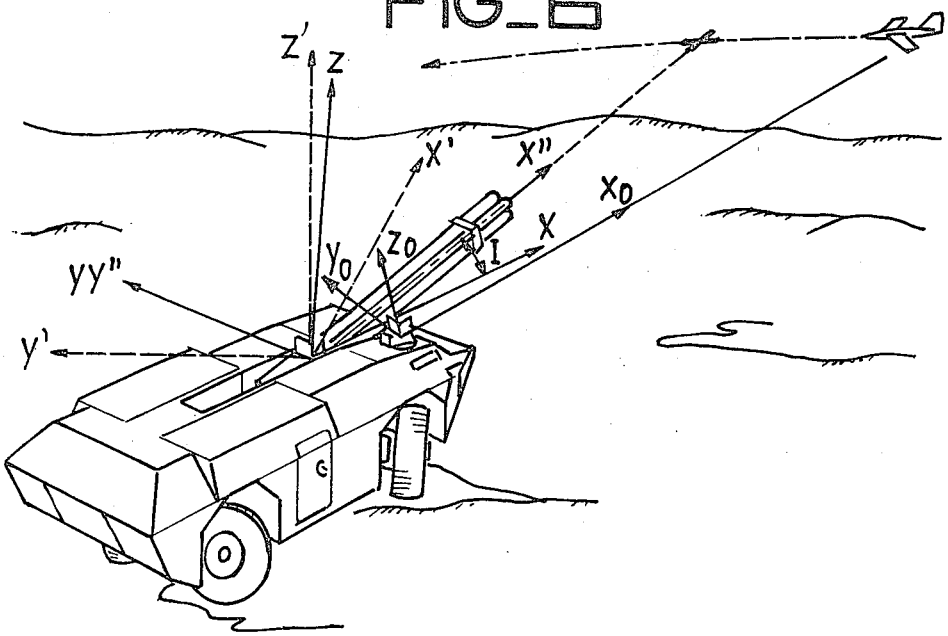
FIG. 6 is a diagrammatic perspective view of the system in a suitable position for firing.

FIG. 6 shows the weapon-carrying vehicle ready for firing. This drawing illustrates how the vehicle in the form of a weapon system is able to either monitor possible targets when travelling normally and on the basis of external information, or is able to carry this out autonomously, the vehicle having a sight glass and a tracking sight.

A vehicle reference trihedron OXYZ is defined in which the X axis is the forward movement axis of the vehicle, the Y axis is the axis in the attitude plane which is marked relative to the chassis and is horizontal when the vehicle is on a horizontal plane, the suspension systems are set to the same height and there is an identical inflation of the tires and the Z axis is perpendicular to the first two axes and is oriented upwards.

There is also a second reference trihedron OX'Y'Z' permitting the use of external information transmitted by, for example, an external sensor or an operational center. In this trihedron the OX' axis is directed towards the north, the OY' axis towards the west and the OZ' axis is vertical and directed upwards.

There is also a third reference trihedron, connected with the tracking operation, namely $OX_oY_oZ_o$ in which the $OX_o$ axis is directed at the target, the $OY_o$ axis is perpendicular to the $OX_o$ axis and parallel to the attitude and the $OZ_o$ axis is perpendicular to the first two axes.

No matter whether the vehicle is travelling normally or is on any ground surface, the possible targets are monitored by the optical omnidirectional monitoring station or by an electromagnetic sensor 9. The optical omnidirectional monitoring station comprises, for example, a large field sight glass, whose sight axis can be displaced in elevation from $-15°$ to $+90°$ and scans all the bearings, whilst the eyepieces in front of the operator are fixed relative to the vehicle chassis. The sighting axis can be remotely controlled at constant speed in bearing for sweeping about a vertical axis, even when the vehicle has a relatively marked tilt.

The acquisition of the target by its tracking sight can take place with the vehicle in the travelling position. Like the sight or monitoring glass, the tracking sight is equipped with eyepieces which are fixed relative to the chassis and its sighting axis $OX_o$ can be displaced in all the space above the ground surface. Tracking which is started for the vehicle in the travelling position can continue when the vehicle stops and comes into the self-rotation position. This enables the weapon to track the target in bearing by means of the vehicle, whose angle with the sighting axis is established by the computer.

Figure 7:
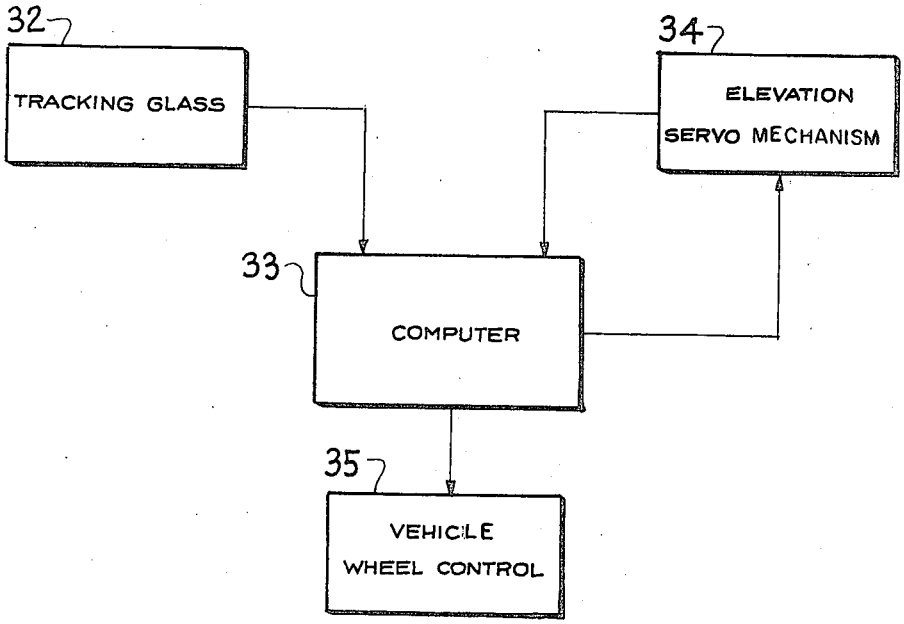
FIG. 7 is a schematic view of the bearing and elevation control system for the weapon.

FIG. 7 is a diagram of the site and elevation bearing error control. The tracking sight 32 supplies values S of the elevation angle of the sight relative to the vehicle attitude platform, values of the bearing angle relative to the vehicle axis and measurements of the absolute angular velocity in the vertical and lateral directions of the sight line, namely $\Omega Y$ and $\Omega Z$. These measurements are transmitted to the vehicle-bound computer 33, as is the measurement of the elevation I of the weapon given by the elevation servomechanism 34 thereof. Bearing in mind the projectile characteristics given by the weapon, this computer evaluates the elevation angle $\bar{I}$ of the weapon and the angle $\bar{g}$ between the weapon and the sight. It also compares values I and $\bar{I}$ to supply the elevation servomechanism 34 with the weapon elevation. It compares values $\bar{g}$ and g to supply to the control circuit for the vehicle wheels 35 the data for controlling the self-rotation speed of the vehicle.

It should be noted that the way in which the values of the aforementioned parameters is determined is not given in detail because it is known and does not form part of the invention.

Figure 8:
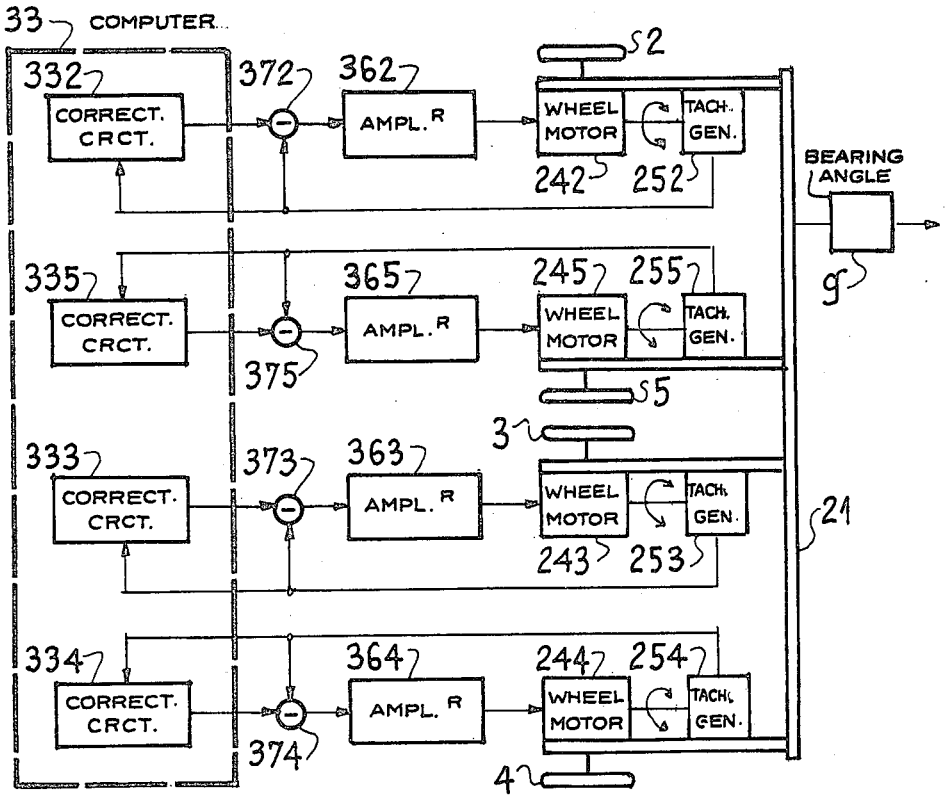
FIG. 8 is a schematic view of the vehicle-rotation guidance system of the carrying vehicle.

FIG. 8 is a diagram of the self-rotation control of the vehicle on the basis of the data supplied by computer 33. Each wheel 2, 5, 3, 4 has its own guidance control system. The self-rotation speeds to be given to the wheels are supplied by computer 33 by correction circuits 332, 335, 333 and 334, the final digit corresponding to the wheel in question.

On the basis of the computer correction circuit, each control system comprises a subtracting circuit 372-375-373-374, an amplifier 362-365-363-364 and the motor for the corresponding wheel 242, 245, 243, 244.

As stated hereinbefore, a tacheometric generator 252-254-253-254 is associated with each wheel, so that the control of the corresponding wheel is made linear. To provide a better understanding of the location of the different components of the wheel control system, the drawing shows the vehicle chassis 21, wheels 2–5 and 3–4 as well as the vehicle axis OX which coincides with the gun axis in bearing, whose value g is the angle measured relative to the sight bearing. Each generator is included in a correction loop leading to the subtracting circuit and the correcting circuit.

Figure 9:
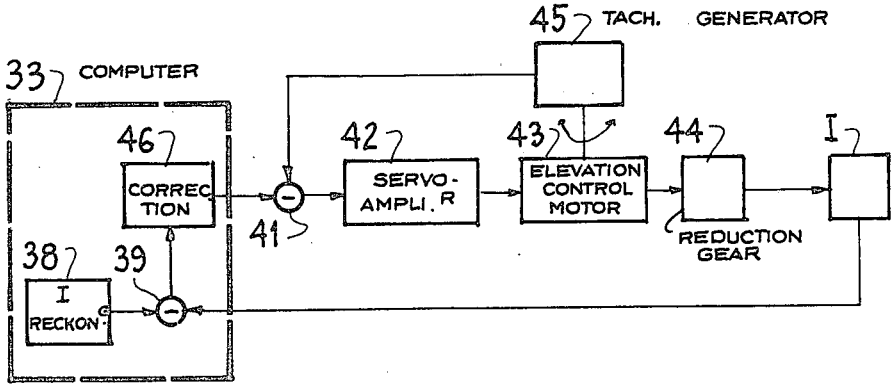
FIG. 9 is a schematic view of the weapon elevation guidance system.

FIG. 9 is a diagram of the weapon elevation guidance system. The guidance control channel leaves computer 33 which contains a device 38 for calculating angle I connected to a subtractor 39, whose output supplies a correcting circuit 46. This circuit supplies a so-called control elevation angle value which, across a subtracting circuit 41 is applied to a servomechanism amplifier 42 and to the weapon elevation control motor 43 connected to a tachometric generator 45 which is inserted in a loop closed on the subtracting circuit 41. Motor 43 controls the elevation weapon orientation across a reduction gear 44 and a correction loop is established on the basis of the weapon which is closed on the subtractor 39 of the computer.

A carried weapon system with a high orientation mobility has been described in which the weapon can fire at land and air targets with a very wide angle in elevation and 360° in bearing, the mobility in elevation being permitted due to the absence of the turret and a special arrangement of the wheeled carrying vehicle.

Other advantages devolve from the arrangements according to the invention. The absence of the turret makes it possible to lower the elevation axis of the weapon, so that the recoil forces can be increased without destabilizing the vehicle, which also gives the vehicle a low silhouette with a height below 2 meters, permitting easy camouflage particularly in undulating ground. Moreover, the arrangement of the weapon in a shaft external of the cockpit permits a considerable deflection, great ease of ejecting residues and the possibility of a very considerable recoil.

What is claimed is:

1. A turretless weapon system comprising:

a low-profile vehicle including:

a vehicle body having a longitudinal axis and formed with a channel extending along said axis and opening upwardly, downwardly and toward a front end of the vehicle, a chassis supporting said body, a plurality of driving and guide wheels supporting said chassis on the ground and spaced apart from one another, means for independently driving said wheels, and means for pivoting said wheels so that said vehicle is rotatable about a point at the center of a circle to which said wheels are tangent;

a cradle disposed in said channel and swingable about an elevation axis perpendicular to said longitudinal axis; and a weapon having at least one tube for launching a projectile mounted in said cradle for elevation from and lowering into said channel through an elevation range of about $-15°$ to $+90°$ whereby bearing of said weapon upon a target through a range of about 360° is effected by autorotation of the vehicle about said center.

2. The weapon system defined in claim 1 wherein said means for independently driving said wheels includes a respective electric motor operatively connected to each wheel;

a respective hydraulic suspension is provided for each wheel; and the downwardly open channel permits discharge of firing residues onto the ground.

3. The weapon system defined in claim 1, further comprising:

a sighting device on said body; and control means on said body responsive to said sighting device for automatically controlling said wheels to said weapon to bear upon a target selected by said sighting device.

4. The weapon system defined in claim 3 wherein said control means includes a computer on said body for supplying to each wheel a rotation speed control signal through a correction circuit connected to an amplifier each of said motors being operatively connected to a tachometer.

5. The weapon system defined in claim 4, further comprising a target designation unit on said vehicle body operatively connected to said computer for providing an input thereto.

6. A turretless weapon system comprising:

a low-profile vehicle including:

a vehicle body having a longitudinal axis and formed with a channel extending along said axis and opening upwardly, downwardly and toward a front end of the vehicle, a chassis supporting said body, a plurality of driving and guide wheels supporting said chassis on the ground and spaced apart from one another, means for independently driving said wheels, and means for pivoting said wheels so that said vehicle is rotatable about a point at the center of a circle to which said wheels are tangent;

a cradle disposed in said channel and swingable about an elevation axis perpendicular to said longitudinal axis;

a weapon having at least one tube for launching a projectile mounted in said cradle for elevation from and lowering into said channel through an elevation range of about −15° to +90° whereby bearing of said weapon upon a target through a range of about 360° is effected by autorotation of the vehicle about said center;

a sighting device on said body for sighting a target;

a computer on said body connected to said sighting device for supplying a rotation speed control signal for each wheel; and a guidance control channel for each wheel receiving a respective signal and including a correction device connected to an amplifier supplying a wheel motor connected to a tachometer generator.

* * * * *